United States Patent [19]

May et al.

[11] Patent Number: 4,630,018

[45] Date of Patent: Dec. 16, 1986

[54] MOLDED CASE CIRCUIT BREAKER CURRENT TRANSFORMER WITH SPIRAL BUS

[75] Inventors: William E. May, Lawrenceville; Ronald W. McKinney, Grayson; James S. Wells, Atlanta, all of Ga.

[73] Assignee: Siemens Energy & Automation, Inc., Atlanta, Ga.

[21] Appl. No.: 796,562

[22] Filed: Nov. 8, 1985

[51] Int. Cl.[4] ..... H01F 17/06; H01F 27/30

[52] U.S. Cl. ..... 336/175; 336/223; 336/225

[58] Field of Search ..... 336/229, 222, 223, 225, 336/82, 174, 175

[56] References Cited

U.S. PATENT DOCUMENTS

| | | | |
|---|---|---|---|
| 508,620 | 11/1893 | Johnson et al. | 336/223 X |
| 662,162 | 1/1901 | Thomson | 336/223 X |
| 691,404 | 1/1902 | Meyers | 336/223 X |
| 1,022,880 | 4/1912 | Schmidt | 336/174 |
| 1,722,444 | 7/1929 | Reiche | 336/223 X |
| 2,246,167 | 6/1941 | D'Entremont | 336/223 X |
| 2,715,669 | 8/1955 | Dicke | 336/225 X |
| 3,629,761 | 12/1971 | Lundgren et al. | 336/223 X |
| 3,761,776 | 9/1973 | Willard . | |
| 3,826,967 | 7/1974 | Wilkinson et al. | 336/223 X |
| 4,159,457 | 6/1979 | Charpentier | 336/223 X |
| 4,181,389 | 1/1980 | Kiesel et al. | 339/32 M |
| 4,281,359 | 7/1981 | Bayer et al. | 361/115 |

FOREIGN PATENT DOCUMENTS

| | | | |
|---|---|---|---|
| 20818 | 7/1956 | Fed. Rep. of Germany | 336/229 |
| 1253353 | 11/1967 | Fed. Rep. of Germany | 336/223 |
| 1308052 | 9/1962 | France | 336/223 |
| 1080320 | 8/1967 | United Kingdom | 336/82 |

OTHER PUBLICATIONS

IBM Technical Disclosure Bulletin, J. K. Radcliffe, "Flat Winding Transformer", vol. 22, No. 9, Feb. 1980, pp. 4009–4012.

*Primary Examiner*—Thomas J. Kozma

*Attorney, Agent, or Firm*—F. W. Powers; J. L. James

[57] ABSTRACT

A current transformer is provided for the electronic trip unit of a molded case circuit breaker. The current transformer has a core with a winding encoiled about the core and a bus spiraled about the core. The spiral bus establishes a current path from one end of the bus to the other which will conduct current through the core in a spiral fashion. The spiral bus design effectively rotates the bus 90 degrees achieving a narrow transformer design which fits into the electronic trip unit without increasing the width of the trip unit.

8 Claims, 9 Drawing Figures

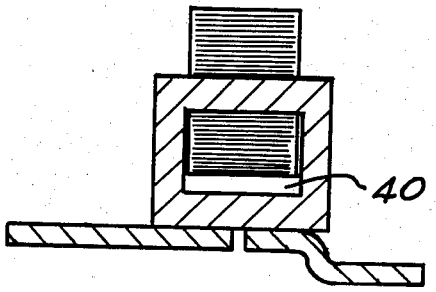
FIG. 5
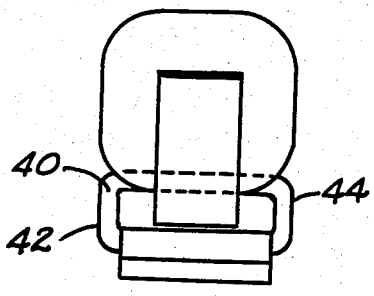
FIG. 6
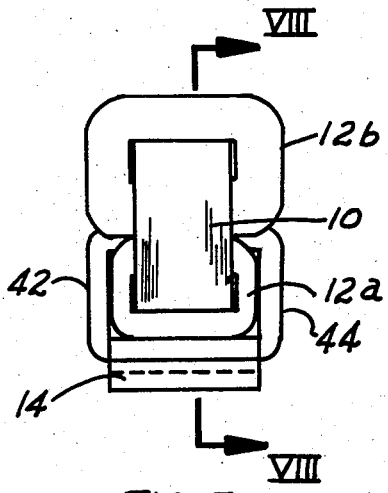
FIG. 7
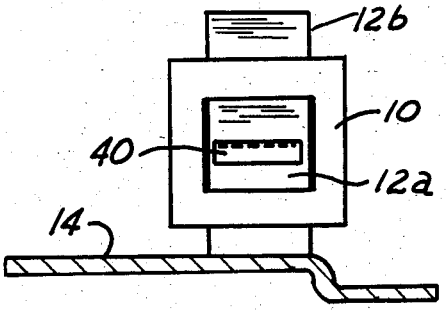
FIG. 8
FIG. 9
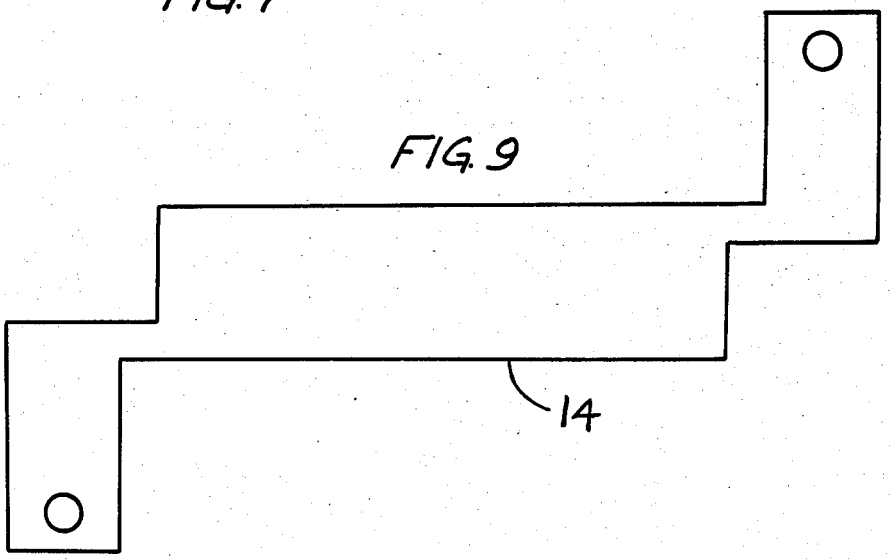

MOLDED CASE CIRCUIT BREAKER CURRENT TRANSFORMER WITH SPIRAL BUS

BACKGROUND OF THE INVENTION

This invention relates generally to molded case circuit breakers and more particularly to a current transformer for the solid state trip unit of the circuit breaker.

The use of modern circuit breakers with electronic trip systems is increasing. An obvious reason for this is the inherent versatility and precise repeatability of selected trip time response characteristics which are an improvement over the prior thermal and magnetic trip units. Because of the obvious advantages of using electronic trip units in circuit breakers, these electronic units are being used in smaller circuit breakers to provide these advantages throughout the entire line of circuit breakers.

Part of the reason for the concern about the size of the trip system is that manufacturers are making circuit breakers smaller. In recent years there has been a reduction in the overall size of circuit breakers or to state it more accurately, greater current interrupting capability is now demanded in the same space previously occupied for lower current interrupting ratings. The end result is that circuit breakers are smaller.

While it is possible to take some steps to reduce the size of electronic trip systems, one of the limiting factors in the size reduction of electronic trip units is the current transformer. Typically, there is one current transformer per phase in the trip unit; thus, in a three-phase system, there will be at least three current transformers. At the lower end of the circuit breaker line, in order to fit electronic trip systems into the small space allocated, the current transformers must typically be no wider than about an inch.

Typical current transformers used in circuit breakers are illustrated in U.S. Pat. No. 4,181,389 which issued on Jan. 1, 1980 to G. W. Kiesel and H. G. Willard, U.S. Pat. No. 3,761,776 which issued on Sept. 25, 1973 to H. G. Willard and U.S. Pat. No. 4,281,359 which issued on July 28, 1981 to E. W. Bayer and E. A. Palmisano. These patents illustrate current transformer arrangements wherein the transformer coil is encoiled about the transformer core with a bus or current carrying member extending through the core in such a fashion that current flows through the center of the transformer core to set up the appropriate magnetic flux. Unfortunately, the bus adds to the width of the current transformer requiring that the dimensions of the trip unit be increased to accommodate the bus thereby making the bus a limiting factor in the size reduction of the current transformer and the trip unit. Accordingly, it will be appreciated that it will be highly desirable to provide a current transformer in which the bus is not a limiting factor in the size of the electronic trip unit.

Accordingly, it is an object of the present invention to provide a current transformer for a circuit breaker.

Another object of the present invention is to provide a bus arrangement for a current transformer which does not increase the width of the tranformer.

SUMMARY OF THE INVENTION

Briefly stated, in accordance with one aspect of the invention, a current transformer is provided for a circuit breaker. The current transformer has a core and a winding encoiled about the core. A bus is spiraled about the core. The bus has a first conducting portion with an end and first and second sides, a second conducting portion with an end and first and second sides and a connecting member with first and second connecting portions. One connecting portion is connected to the first side of the first conducting portion and the connecting portion is connected to the second side of the second conducting portion. This forms a spiral current path for current to flow from the end of the first conducting portion to the first side of the first conducting portion, one connecting portion, the connecting member, the other connecting portion, the second side of the second conducting portion and to the end of the second conducting portion.

The spiral bus configuration effectively rotates the bus 90 degrees achieving a narrow transformer which fits in the limited space of an electronic trip unit.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

FIG. 5 is a longitudinal sectional view of the current transformer of FIG. 1 further illustrating the spiral bus;

FIG. 6 is a right end view of the current transformer illustrated in FIG. 1;

FIG. 7 is a right end view similar to the right end view of FIG. 6 but illustrating a current transformer which has two coils;

FIG. 8 is a longitudinal sectional view similar to FIG. 5 but illustrating a current transformer which has two coils and taken along line VIII—VIII of FIG. 7; and FIG. 9 illustrates a stamped sheet of copper prior to being formed into a bus.

DESCRIPTION OF THE PREFERRED EMBODIMENT

Figure 1:
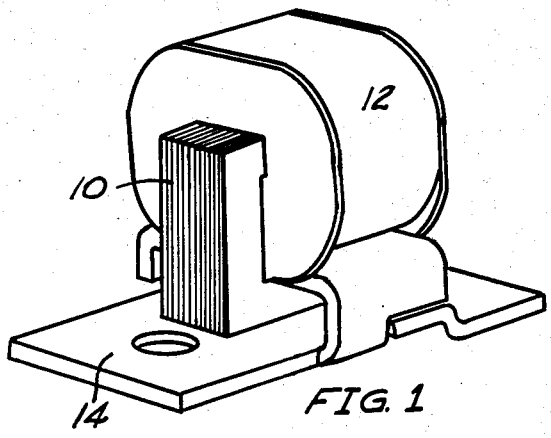
FIG. 1 is a perspective view of a current transformer incorporating the spiral bus of the present invention.
Figure 2:
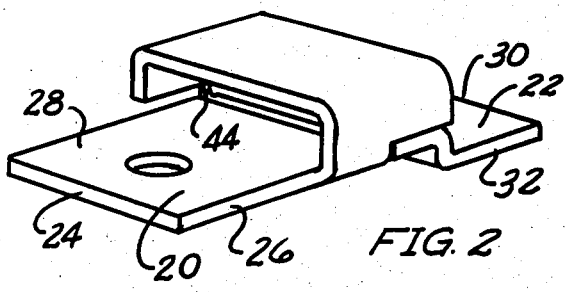
FIG. 2 is a perspective view of the spiral bus similar to FIG. 1 but without the transformer core and coil.
Figure 3:
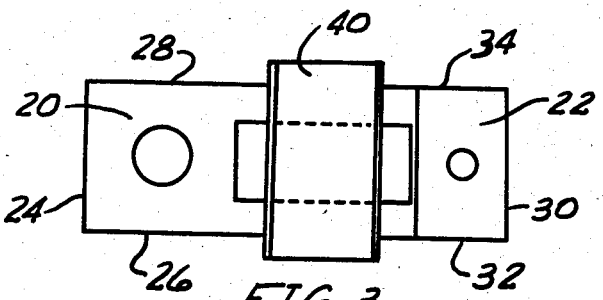
FIG. 3 is a top view of the spiral bus of FIG. 2.
Figure 4:
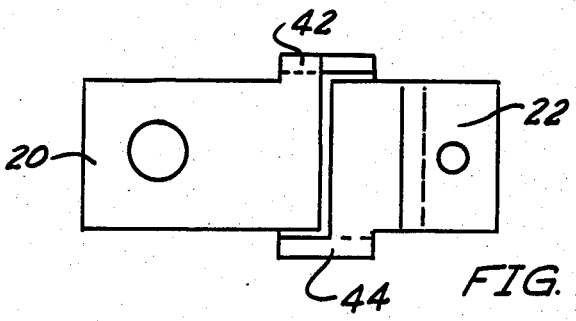
FIG. 4 is a bottom view of the spiral bus of FIG. 2.

Referring to FIG. 1, a current transformer for an electronic trip unit of a molded case circuit breaker has a core 10 and a winding 12 encoiled about the core. The core is preferably constructed of laminated steel which forms a closed loop about a window. The winding 12 is encoiled about one leg of the core 10 and passes through the window so that the coil winding 12 encircles the core 10. The current transformer also includes a bus 14 which is spiraled about the core 10. By this construction, current spirals through the window of the core 10 causing magnetic flux to flow in the core material. The core 10 passes through one or two secondary winding coils inducing a current in them proportional to the primary current.

Referring to FIGS. 2 through 6, the bus 14 has a first portion 20 and a second portion 22 which are preferably of planar configuration. The first generally planar portion 20 has an end 24 and first and second sides 26, 28. The second generally planar portion 22 has an end 30 and first and second sides 32, 34 with the first side 32 of the second planar member 22 being on the same side of the bus 14 as the first side 26 of the first planar portion 20. Likwise, the second side 28 of the first planar portion 20 is on the same side of the bus 14 as the second side 34 of the second planar member 22.

The bus 14 also has a connecting member 40 which has a general inverted U-shaped configuration with each leg of the U having a connecting portion. The first connecting portion 42 is connected to the first side 26 of the first planar portion 20 and the second connecting portion 44 is connected to the second side 34 of the second planar portion 22 forming a spiral current path. The current path extends, for example, from the end 24 of the first planar member 20 to the first side 26 of the first planar member 20 and to the first connecting portion 42 of the U-shaped connecting member 40 through the U-shaped connecting member 40 to the second connecting portion 44 of the connecting member 40 to the second side 34 of the second planar member and finally to the end 30 of the second planar member. Thus, the current spirals through the window of the core 10 causing a magnetic flux to flow in the core material. The core 10 passes through the secondary winding coil 12 inducing a current flow proportional to the primary current.

The spiral current path is possible because the bus 14 is constructed so that the first portion 20 and second portion 22 are free of electrical contact with one another and are electrically connected only by the connecting portion 40. Current flows from the first portion 20 to the second portion 22 only by way of the connecting portion 40. The spiral current path is formed so that current flows from one side of the transformer to the other by flowing through the connecting portion 40 which connects one side of the first portion 20 with the opposite side of the second portion 22. Also, the U-shaped connecting portion 40 and the conducting portions 20, 22 form a window or opening through which the core 10 extends.

The spiral bus 14 can be formed by an extrusion process from conductive material. The extrusion process shapes the conductive material into the desired hollow cross-sectional configuration and excess material is cut away forming the first and second planar portions 20, 28. Additional machining electrically separates the first and second portions 20, 22 except for the electrical conducting path through the connecting portion 40. The spiral bus can also be formed from a sheet of conductive material, such as copper, for example. The sheet of material is stamped in the configuration shown in FIG. 9 and thereafter folded into the finished shape shown in FIG. 2. This stamping and forming process has the advantage of being a fast manufacturing process. On the other hand, an extruded bus has the advantage of being extruded to close tolerances.

Referring to FIGS. 7 and 8, the current transformer may have two coils 12*a* and 12*b* arranged vertically one atop the other. In such a configuration, the connecting portion 40 of the bus 14 is extended on elongated connecting legs 42, 44 so that the coil 12*a* fits inside the spiral bus and the coil 12*b* is outside the spiral bus. The core and the core window are larger in the configuration of FIG. 7 so that the coil 12*a* can be encoiled about one leg of the core while the coil 12*b* is encoiled about the other leg of the core. The connecting portion 40 of the bus 14 passes through the core window between the coils 12*a* and 12*b*. Also, the connecting portion 40, legs 42, 44 and conducting portions 20, 22 form an opening through which the core extends with the coil 12*a* encoiled thereon. By this construction, the current spirals through the window of the core causing a magnetic flux to flow in the core material. This core passes through two secondary winding coils inducing a current to flow in them proportional to the primary current.

It will now be understood that there has been disclosed an improved current transformer which has a spiral bus arrangement. The spiral bus arrangement in effect rotates the bus 90 degrees so that the resulting transformer has a small width compared to conventional transformer designs. Basic to the design of the compact current transformer is the spiral bus structure which is formed to achieve a spiral through the core and coil assembly. The spiral bus may be used effectively with a single coil arrangement or it may be used with a two-coil arrangement with the coils being of unequal size to achieve a maximum in space efficiency. It may also be used with two coils of equal size. Each configuration yields a narrow transformer without compromising core cross-sectional area or coil wire size. The unique bus design can be fabricated in a variety of ways such as casting, for example. The unique bus design could also be machined from an extrusion or stamped from a sheet of metal and formed.

While the operation of the present invention is believed clearly apparent from the foregoing description, further amplification will subsequently be made in the following brief summary of such operation. In operation, the current transformer is assembled with the current transformer coil positioned about one leg of the transformer core and the spiral bus extending through the core window. Primary current flows through the bus along a current path that takes the current from one end of the bus to the first side of the first bus portion where it flows along one leg of the connecting member. The current flows through the connecting member to the other leg of the connecting member to the second side of the second generally planar member and finally out the end of the second planar member. The connecting portion of the bus extends through the window of the core and legs of the connecting member extend at substantially right angles to the connecting member forming an inverted U configuration wherein the current flows from the input side of the bus through one leg across the connecting member down the other leg and out the output member of the bus. The current flows through the core in a spiral fashion causing a magetic flux to flow in the core material. This core passes through one or two secondary winding coils thereby inducing a current flow in them proportional to the primary current. A very compact current transformer design is possible becuase the spiral bus arrangement effectively rotates the core and coils 90 degrees so that the resulting transformer has a small width compared to conventional transformers.

It will now be understood that there has been disclosed an improved bus arrangement for an electronic trip unit of a molded case circuit breaker. The improved bus arrangement is a spiral bus which causes current to spiral through the core of the transformer. The spiral arrangement allows the core and coils to be rotated 90 degrees to maintain a narrow width for the transformer. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A circuit breaker current transformer having a width, comprising:

a core having a window with an axis in a plane;

a winding encoiled about the core defining the transformer width; and a bus having a first conducting portion with an end and first and second sides, a second conducting portion with an end and first and second sides and a connecting member having a first and a second connecting portion with one connecting portion being connected to the first side of the first conducting portion and the other connecting portion being connected to the second side of the second conducting portion forming a current path from the end of the first conducting portion to the first side of the first conducting portion, one connecting portion, the connecting member, the other connecting portion, the second side of the second conducting portion and to the end of the second conducting portion, said bus extending through the core window forming a spiral about the core without increasing said transformer width, said ends of said first and second conducting portions extending on opposite sides of said plane on only one side of said core and extending beyond lateral ends of said core, said conducting portions each having a longitudinal axis which is parallel to the plane of said core effectively rotating the core by about 90 degrees.

2. A current transformer according to claim 1, including a second winding encoiled about the core.

3. A current transformer according to claim 1, wherein the bus is formed from a single sheet of conductive material.

4. A current transformer according to claim 1, wherein the first conducting portion, second conducting portion and the connecting member form an opening.

5. A current transformer according to claim 4, wherein the core extends through the opening formed by the connecting member and conducting portions.

6. A current transformer according to claim 1, wherein the first conducting portion is generally planar.

7. A current transformer according to claim 1, wherein the first and second conducting portions are free of electrical contact with one another and current flow between the first and second conducting portions occurs only through the connecting member.

8. A current transformer according to claim 1, wherein current only flows from one side of the transformer to the other side of the transformer through the connecting members.

* * * * *